US008069896B2

(12) United States Patent
Magro

(10) Patent No.: US 8,069,896 B2
(45) Date of Patent: Dec. 6, 2011

(54) METHOD AND APPARATUS FOR DRIVING A ROLLER SHUTTER DOOR

(75) Inventor: Sebastian Magro, Stony Brook, NY (US)

(73) Assignee: Alpine Overhead Doors, Inc., East Setauket, NY (US)

( * ) Notice: Subject to any disclaimer, the term of this patent is extended or adjusted under 35 U.S.C. 154(b) by 462 days.

(21) Appl. No.: 12/410,163

(22) Filed: Mar. 24, 2009

(65) Prior Publication Data

US 2010/0242364 A1 Sep. 30, 2010

(51) Int. Cl.
*E05F 15/20* (2006.01)

(52) U.S. Cl. ..... 160/1; 160/7; 160/8; 318/452

(58) Field of Classification Search ..... 318/452; 160/1, 7, 8, 9

See application file for complete search history.

(56) References Cited

U.S. PATENT DOCUMENTS 5,203,392 A 4/1993 Shea
5,221,239 A 6/1993 Catlett
5,245,879 A * 9/1993 McKeon ..... 74/2
5,253,693 A 10/1993 Marlatt et al.
5,261,186 A 11/1993 Saino
5,263,527 A 11/1993 Marlatt et al.
5,482,103 A 1/1996 Burgess et al.
5,560,658 A 10/1996 Coolman et al.
5,881,497 A 3/1999 Borgardt
5,893,234 A * 4/1999 McKeon ..... 49/30
5,896,907 A 4/1999 Dever et al.
5,924,949 A 7/1999 Fan
6,422,965 B1 7/2002 Balli et al.
6,484,784 B1 * 11/2002 Weik et al. ..... 160/7
6,530,863 B2 3/2003 Balli et al.
6,688,447 B1 2/2004 Liu
7,261,139 B2 8/2007 Varley et al.
2002/0153854 A1 * 10/2002 Reed et al. ..... 318/466

* cited by examiner

*Primary Examiner* — Walter Benson
*Assistant Examiner* — Jorge Carrasquillo
(74) *Attorney, Agent, or Firm* — Lackenbach Siegel, LLP; Myron Greenspan

(57) ABSTRACT

The present invention is a method and apparatus for driving a roller-shutter door having a drive mechanism. The method comprises the activation of a circuit in response to an external stimuli to a switch. This actuates a timer and raises a timing bar. A cable passes across the timing bar and is connected to the switch on one end and to a solenoid on a second end. The cable passes through a top portion of a rocker arm assembly having a one-way bearing. The solenoid is actuated as a result of the raising of the timing bar; and activates the one-way bearing to cause the door to be raised to a pre-set position for a pre-set period of time. To reverse the door, the timer bar is dropped after the lapse of the pre-set period of time. The solenoid is re-activated and reverses the one-way bearing.

27 Claims, 13 Drawing Sheets

ENLARGED VIEW

METHOD AND APPARATUS FOR DRIVING A ROLLER SHUTTER DOOR

BACKGROUND OF THE INVENTION

1. Field of the Invention

The present invention relates to a method and apparatus for driving roller shutter doors to a closed or open state. More specifically, the present invention relates to a controller for applying motive power to a roller shutter door of the type used to retard passage in the event of fire, smoke or similar conditions, or, of doors simply used to prevent egress or entrance based on the time of day or the opening or closing of the facility to which the door is a portal.

2. Description of the Related Art

Roller shutter doors have been known for some time and are used in a variety of applications. They include such categories as: rolling grille; storm doors; fire and smoke doors; air-leakage doors, counter shutters; and, the like. What they have in common is a construction that allows them to be rolled up onto a drum or tube when in the open position; or, to be unreeled from the drum when the door is being lowered. Theses doors are typically used in commercial establishments to seal or close off large doorways, or bays, and can be operated electrically, manually, or both.

The methods and systems for driving the doors into an upward or downward position, during normal or emergency operation, have evolved over time from simple pull down doors of a kind used in residential garages, to more technologically advanced electric drive systems with timers, manual over-rides, and diverse safety features.

Generally, commercial or large capacity fire doors were driven by electric motors to open or close the door. However, when a fire occurred, these mechanisms would disengage the motor from the fire door and allow the door to close under the pressure exerted by an auxiliary spring activated by mechanical means or from a counterbalance. These mechanical means included pendulums, oscillating governors, friction discs, ratchets, etc. These mechanical devices tended to be unreliable because of jamming or other malfunctions caused by the motion of the door. One early mechanism that attempted to address this problem was described in U.S. Pat. No. 5,203,392 for a Mechanism For Controlling The Raising And Lowering Of A Door, issued Apr. 20, 1993 to Shea (hereinafter referred to as "Shea").

In Shea, there is disclosed a mechanism for controlling the opening and closing of a door such as a fire door. The mechanism controls the speed of the door when it drops under the force of gravity; and, can be electrically, or manually, operated. The problem that Shea was attempting to address was the need for a fire door mechanism that regulates the raising and lowering of the door while effectively controlling the door's movement without the need of springs or similar mechanical means. The speed of the door's drop was under control of a centrifugal governor employing brake shoes.

Other prior art has addressed the need for testing the speed and effects of the door's drop during non-emergency uses. U.S. Pat. No. 5,482,103 for a Door Apparatus With Release Assembly, issued Jan. 9, 1996 to Burgess et al. (hereinafter referred to as "Burgess") teaches the use of a counterweight to offset the weight of the roller door and a reducing weight to reduce the weight of the counterweight. The assembly of the door allows the use of a standard governor to control downward speed. This use of reduced weight and the resultant reduced stress on the door allows the mechanism to use parts that are reduced in size and weight.

After the disclosures of Shea and Burgess, came the teachings of U.S. Pat. No. 5,924,949 for an Apparatus For Driving A Roller Shutter Door, issued Jul. 20, 1999 to Fan (hereinafter referred to as "Fan"). Fan teaches a driving mechanism for roller shutter doors that can be adjusted from outside of the apparatus so as to accommodate doors of different heights. The advantage of Fan is that the mechanism, if either moved from a door of one height to a door of a differing height, or if the door is not of the height for which the factory settings apply, does not have to be disassembled for adjustments. Rather, the adjustable control means is disposed within the stationary housing of the apparatus, and extends from within the apparatus to a point outside where it can be manipulated or adjusted as required. And, while Fan addresses a legitimate need, it still leaves unanswered the need to allow the door to move freely into an open position while under control of a governor.

Further improvements to the drive mechanism are taught in U.S. Pat. No. 6,530,863 for a Door Operator Unit, issued Mar. 11, 2003 to Balli et al. (hereinafter referred to as "Balli"). In Balli, an improved power transmission mechanism which works between the drive motor and the operator output shaft is disclosed. The operator unit is adapted to reverse the positions of a manual operator drive and a release mechanism. The advantage provided by Balli is the ability to interchange the operator unit components depending upon the door configuration or application. Thus, the drive mechanism can be established as either a right side or a left side mount. Balli still leaves the question of door control after rebounding, or the issue of timer adjusted openings and closings to be addressed.

The evolution of the rollup door and its drivers and safety mechanisms has continued with the disclosures of U.S. Pat. No. 7,261,139 for a Manual Operating Mechanism For Upward Acting Door, issued Aug. 28, 2007 to Varley et al. Varley teaches a mechanism that addresses the difficulty of operating a roll-up door manually in those cases where the drive motor is mounted in an assembly that is beyond the easy reach of the user. The mechanism of Varley includes a manual brake release that is foot actuated by a person using an elongated crank handle to manually move the door from an open to closed position or vice versa. A problem left unanswered by Varley is how an operator, under the stress of an emergency, can efficiently disengage the motor drive.

What is not appreciated by the prior art is the need to provide a method and apparatus for controlling the drop of the door (or curtain as the case may be) that incorporates each of the successes of the prior art while minimizing the problems. One important issue not addressed by the prior art, is that the drop of the door should be controlled by a mechanical centrifugal governor such that the door does not "bounce" after it arrives in the full open position. While in a closed position, the curtain or door must be able to maintain its locked position unless the door or curtain is manually released through the use of a manual lever and/or an electrical switch. The use of a timer to allow the door to re-open at least part-way, and then close after a specific time interval during an emergency, would provide a safety that is currently lacking in the art.

Accordingly, there is a need for an improved method and apparatus that will supply multiple safety features in the event of an emergency while providing for more efficient operation of the door during normal use.

OBJECTS AND SUMMARY OF THE INVENTION

An object of the present invention is to provide a mechanism for driving a roller-shutter door that can be operated in an emergency by hand push-up, manual chain drive, or by motor power.

Another aspect of the present invention is to provide a mechanism for driving a roller-shutter door in response to elevated, unsafe or emergency levels of wind, smoke or fire that are communicated to the mechanism through a sensor coupled to an electrical control mechanism.

An object of the present invention is to provide a mechanism for driving a roller-shutter door that can be operated simply as an egress mechanism when utilized with non fire-rated door applications, thus allowing for emergency egress on standard doors.

The present invention relates to a method and apparatus for driving a roller-shutter door having a drive mechanism. The method comprises the activation of a circuit in response to any one of several external stimuli (such as a smoke detector alarm) to a switch for activating the door's drive mechanism and/or directional movement. This, in turn, actuates a timer and raises a timer arm. A cable passes across the timing arm and is connected to the switch on one end, and to a solenoid on a second end. The cable passes through a top portion of a rocker arm assembly having a one-way bearing. The solenoid is actuated as a result of the raising of the timing arm; and, activates the one-way bearing to cause the door to be raised to a pre-set position for a pre-set period of time. To reverse the door, the timer arm is dropped after the lapse of the pre-set period of time. The solenoid is re-activated and reverses the one-way bearing.

According to an embodiment of the present invention, there is provided a method and apparatus for driving a roller-shutter door having a drive mechanism. The method of the present invention comprises a number of steps beginning with the activation of a circuit in response to an external stimulus (such as a smoke detector alarm) to a switch. The switch can be located in any one of several of locations depending upon design choice or specific environmental requirements. For instance, it can be located on an outer wall of a building supporting the roller shutter door; and wherein the switch is within a break-glass station.

The external stimuli is the closing of a circuit linked to a sensor for measuring an anomaly, such as: an elevated smoke level, excessive heat (caused by a fire or the like), or simply the passage of time as determined by a real time clock.

The activation of the circuit actuates a timer and which in turn raises a timing arm of the timer. A cable passes across a top portion of the timing arm and is connected to the switch on one end and to a solenoid on a second end. The cable passes through a top portion of a rocker arm assembly disposed between the timer and the solenoid; and, wherein the rocker arm assembly comprises a one-way bearing. The solenoid is actuated as a result of the raising of the timing arm; and activates the one-way bearing to cause the door to be raised to a pre-set position for a pre-set period of time under control of the timer and as driven by the drive mechanism.

In reversing the movement of the door, the method further comprises utilizing the timer for a pre-set period of time; and, wherein the timer bar is dropped after the lapse of the pre-set period of time. The solenoid is re-activated in response to the dropping of the timer bar, and reverses the one-way bearing in response to the actuation of the solenoid. The door is then dropped to a closed position in response to the reversing of the one-way bearing. The dropping of the door is caused by gravity; and, the speed of the dropping of the door is under control of a centrifugal speed governor.

The drive mechanism itself for opening or closing the roller-shutter door comprises a number of key elements. The elements include a drive plate having a centrally located hub, and wherein the hub has a geared portion located on the outside surface thereof. There is also a drive gearset having a geared hub mounted coaxially about the central hub of the drive plate; and, a second gear having a geared hub and mounted coaxially about the geared hub of the drive gearset. In addition, there is a stationary housing adapted to accommodate the drive gearset and the drive plate. A motor located externally to the stationary housing for driving the second gear, and control means disposed within the stationary housing and in meshed contact with the central hub for controlling actuation of the motor in response to an external stimuli, and whereby the roller shutter door can be moved to a predetermined limit position are also provided. The drive mechanism also an adjustable gearset that is accessible from outside the stationary housing. Additionally, the drive mechanism comprises the rocker arm assembly and centrifugal speed governor previously noted.

In an alternative embodiment of the present invention, a stepper motor is used in place of the solenoid. When using the solenoid, the method comprises the activation of a circuit in response to any one of several external stimuli (such as a smoke detector alarm) to a switch for activating the door's drive mechanism and/or directional movement. This, in turn, actuates a timer and raises a timer arm. A cable passes across the timing arm and is connected to the switch on one end, and to a stepper on a second end. The cable passes through a top portion of a rocker arm assembly having a one-way bearing. The stepper is actuated as a result of the raising of the timing arm; and, rotates its shaft to cause the door to be raised to a pre-set position for a pre-set period of time. To reverse the door, the timer arm is dropped after the lapse of the pre-set period of time. The stepper motor is re-activated and completes a turn of the shaft to reverse the one-way bearing.

In another embodiment of the present invention, the doors are driven horizontally (relative to the door's threshold) from opposing directions so that they meet in the middle of the threshold. The drive mechanism is the same as that provided for the vertical (up or down) movement of the door, except that the drive is biased horizontally instead of laterally.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
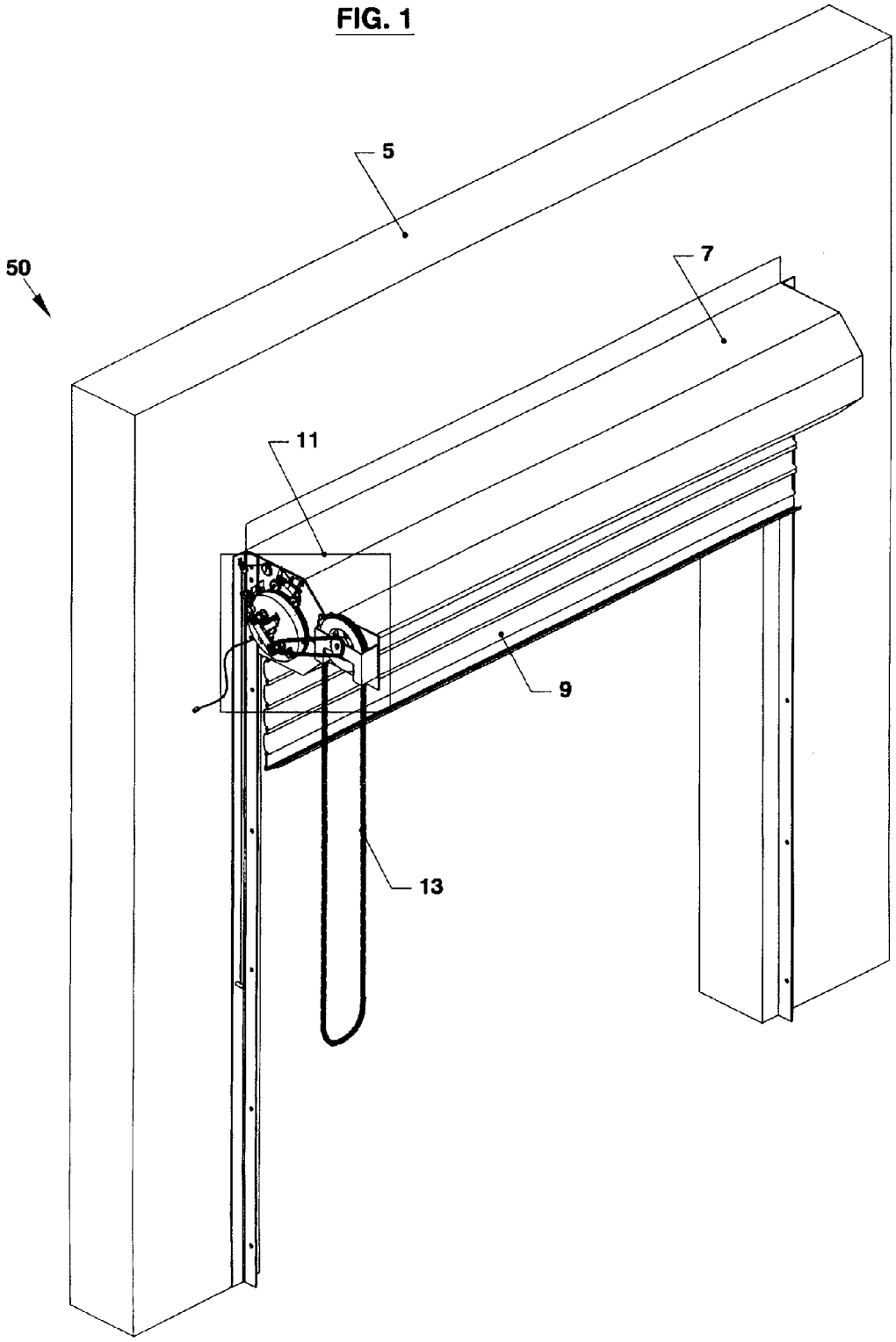
FIG. 1 is an isometric view of a curtain or roller door having a hand chain drive, shown when the door is in the open position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

FIGS. 1-9 are general overviews of the present invention which illustrate the placement of the mechanism relative to the roll-up door to be driven. It is within the scope and teachings of the present invention that the placement of the mechanism can be either on the right side or the left side, of the housing for the roller drum of the door. Indeed, the mechanism is designed in such a way as to provide easy left or right side adjustment.

Turning to FIG. 1, there is shown an isometric view of the system 50 of the claimed invention having a curtain or rolling door 9 having a hand chain drive 13 wherein the rolling door 9 is in the open position relative to the doorway of wall section 5. When rolled up under the control of the hand chain drive 13 of the mechanism 11, the rolling door 9 is wrapped around a drum (not shown) that runs the length of a housing 7.

The rolling door 9 is lowered or raised, as the case may be, by a user pulling on chain 13. The movement of the various components is described in more detail with respect to FIG. 3. The advantage of the current design is the ability to retrofit any of the primary embodiments to existing door drive systems or to upgrade from one embodiment to another. Further, the mechanism allows for driving a rolling door that can be operated simply as an egress mechanism when utilized with non fire-rated door applications, thus allowing for emergency egress on standard doors.

Figure 2:
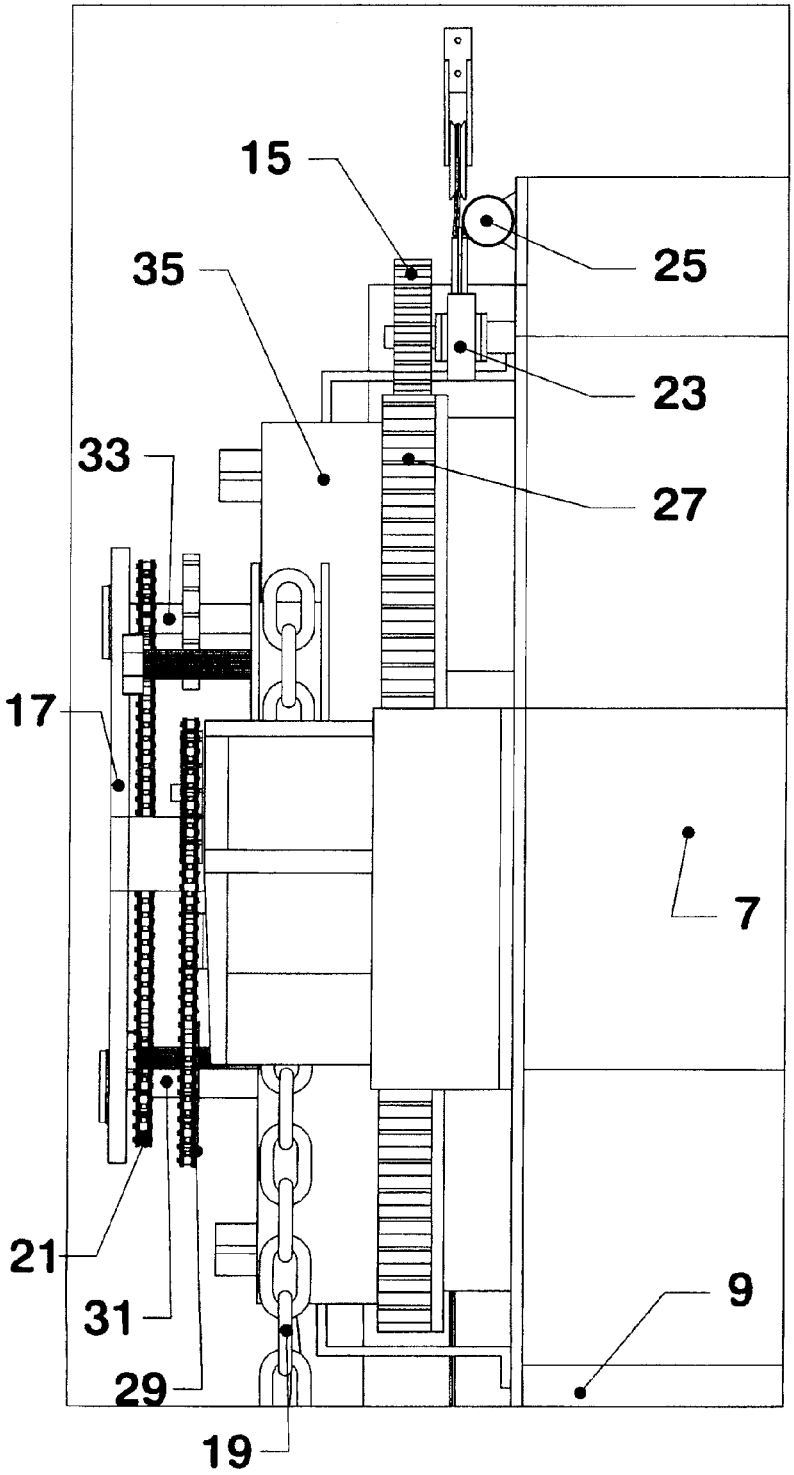
FIG. 2 is an elevation view of a hand chain drive embodiment of the present invention showing the top of the drive chain housing.

For a depth perspective, as to placement and fitting of components, we turn to FIG. 2 where there is shown an elevation view of the hand chain drive embodiment of the present invention showing the side wall of the drive chain housing.

Hand chain drive 19 is shown wherein pulling of the chain turns a shaft (view blocked by the pulley and shaft housing wall) which in turn rotates a gear (not shown in this perspective). The gear moves chain 29 which is connected to a gear on the main gear shaft 31. A chain 21 links main gear shaft 31 with adjusting post 33 and is covered by a plate 17. The main gear shafts 31, 33 drive the interior mechanism of the gearbox 35 (described in more detail with respect to FIGS. 11 and 12), rotating drive gear 27, that causes the rolling door 9 to be rolled up or down. The speed of the roll up is governed by the governor not shown, and measured by the rocker arm 23 through the rotation of rocker arm gear 15. Actuation of the rocker arm 23 for upward or downward movement of the rolling door 9 comes from the in or out action of solenoid 25 under control of the timing switch (not shown).

Figure 3:
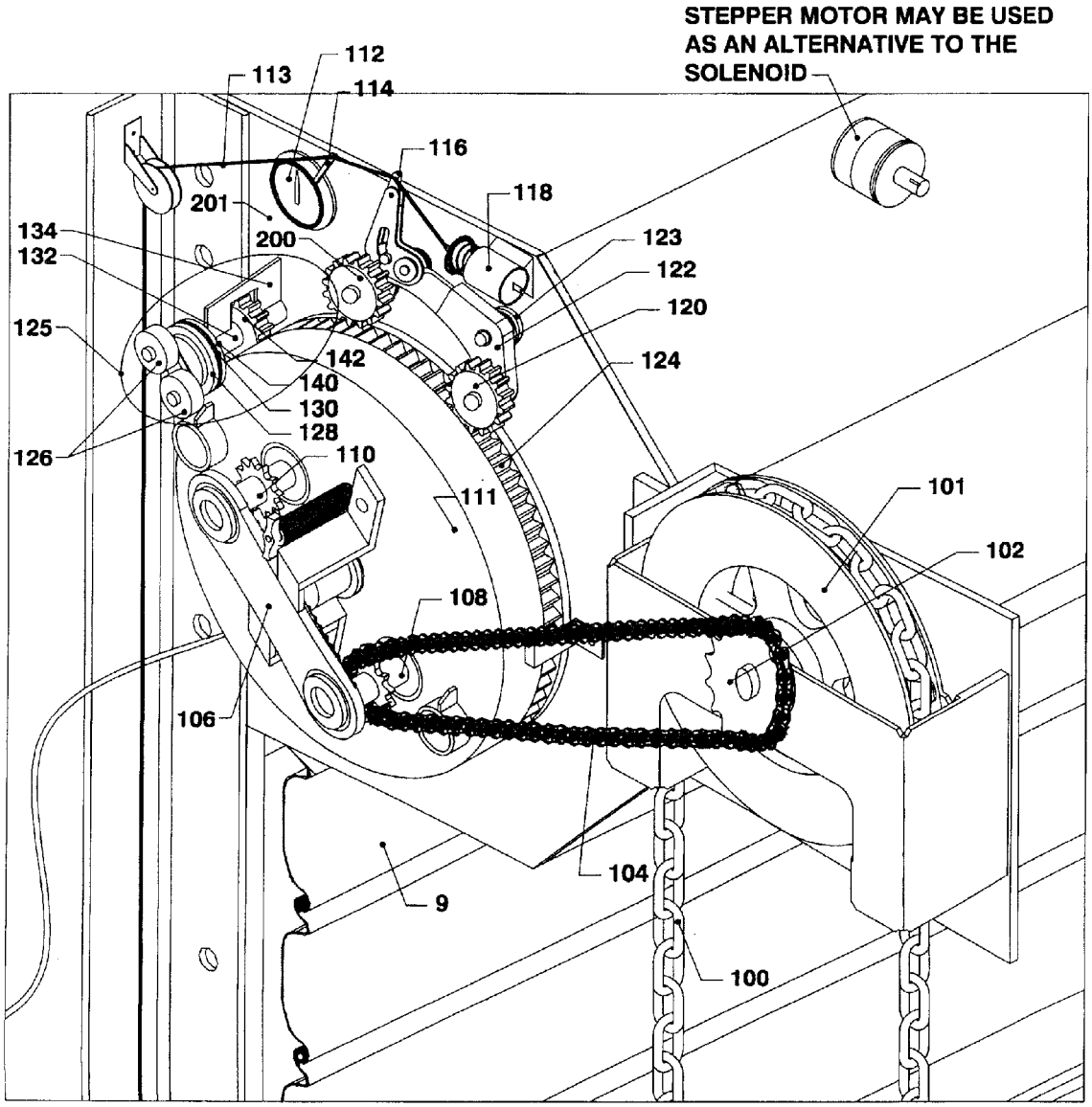
FIG. 3 is an isometric view of the hand chain drive embodiment of the present invention showing the timer, solenoid, rocker arm assembly, and governor.

FIG. 3 is an isometric view of the hand chain drive embodiment of the present invention showing the timer 114, solenoid 118, rocker arm assembly 122, and the speed governor 125.

The hand drive embodiment receives its drive power from the chain 100 being pulled by a mechanism user. The chain rotates pulley 101 which turns gear 102. In turn, gear 102 causes chain 104 to move which drives main gear shaft 108. Main gear shaft 108 supports one end of a chain (not shown) which is covered and protected by plate 106. The other end of the protected chain drives main gear shaft 110. The movement of the main gear shafts causes the inner workings (as shown and described in FIGS. 11 and 12) of the gearbox 111 to rotate drive gear 124. Drive gear 124 rotates an inner shaft which causes the shaft to take up or release door 9 which is wound or unwound from a drum in housing 7. The directionality of the rotation up or down is controlled by the one-way bearing of the rocker arm assembly 122.

There is shown the rocker arm components of the rocker arm 122 as secured just past the 12:00 o'clock position relative to the top of the drive gear 124. Gear 120 is secured to rocker arm body 122 with a one-way bearing (not shown) disposed therebetween. Bracket attachment assembly 123 is used to secure the lower portion of rocker arm body 122 while allowing it to pivot when activated so as to engage the gear 120 with the drive gear 124 to control speed under the directional control of the pivoting one-way bearings. Cable holder 116 is secured between the upper portions of the swing bodies 117 so as to hold the cable 113 which links the solenoid 118 and timer switch 114. The cable is under direction of an emergency back up which causes the timer switch 112 to be set so as to position arm 114 in such a way as to elevate the chain 113 causing the solenoid 118 to be activated which pivots the rocker arm 122 to engage opposite directional, one-way bearing 200. As the timer reaches its "timed out" position, the arm 114 is dropped, causing the solenoid to open, which in turn pivots rocker arm 122 to engage the one-way bearing 200 so that the rolling door 9 will close.

Alternatively, a stepper motor is used in place of the solenoid 118. When using the stepper motor, the motor is activated which pivots the rocker arm 122 to engage opposite directional, one way bearing 200. As the timer reaches its "timed out" position, the timer switch 114 is dropped, causing the stepper motor to turn "a step", which in turn pivots rocker arm 122 to engage the one-way bearing 200 so that the rolling door 9 will close. To reverse the door, the timer switch 114 is dropped after the lapse of the pre-set period of time. The stepper motor is re-activated and completes a turn of the shaft to reverse the one-way bearing.

Alternatively, the doors are driven horizontally (relative to the door's threshold) from opposing directions so that they meet in the middle of the threshold. The drive mechanism is the same as that provided for the vertical (up or down) movement of the door, except that the drive is biased horizontally instead of laterally.

The speed of the door's descent is extremely important in that too great a speed will cause the door to hit the full down position and bounce and be in the wrong position, or cause strain on the mechanism. To avoid these problems, the mechanism utilizes a centrifugal speed governor.

A view of the centrifugal speed governor 125, and its components, is shown wherein the governor 125 is shown as secured between the 10:00 and 11:00 o'clock position relative to the top of the drive gear 124 (its position could change if the mechanism becomes "right-handed"). Clutch weights 126, 126 are slot mounted on the upper portion of the rotor body assembly cap 128. Clutch pad 130 for braking is secured between the rotor body assembly cap 128 and the fixed rotor 140. Cap 128, clutch pad 130, and fixed rotor 140 are combined to form the rotor body assembly.

The rotor body assembly is transected in the center by shaft 132 which supports the rotor body assembly on one end and the governor gear 142 on the opposite end. The gear 142 is in mated contact with the system's main drive gear 124 so as to control the speed of the door 9. The gear 142 bisects the supports 134 which are perpendicular (90 degrees) to each other and welded to the bracket 201.

When activated, the governor 125 rotates to a certain speed, when that speed is increased beyond the threshold speed, slot mounted weights 126 are pulled apart by centrifugal force which causes pressure on the clutch pad 130, causing the governor 125 to brake the speed of the door's descent.

Figure 4:
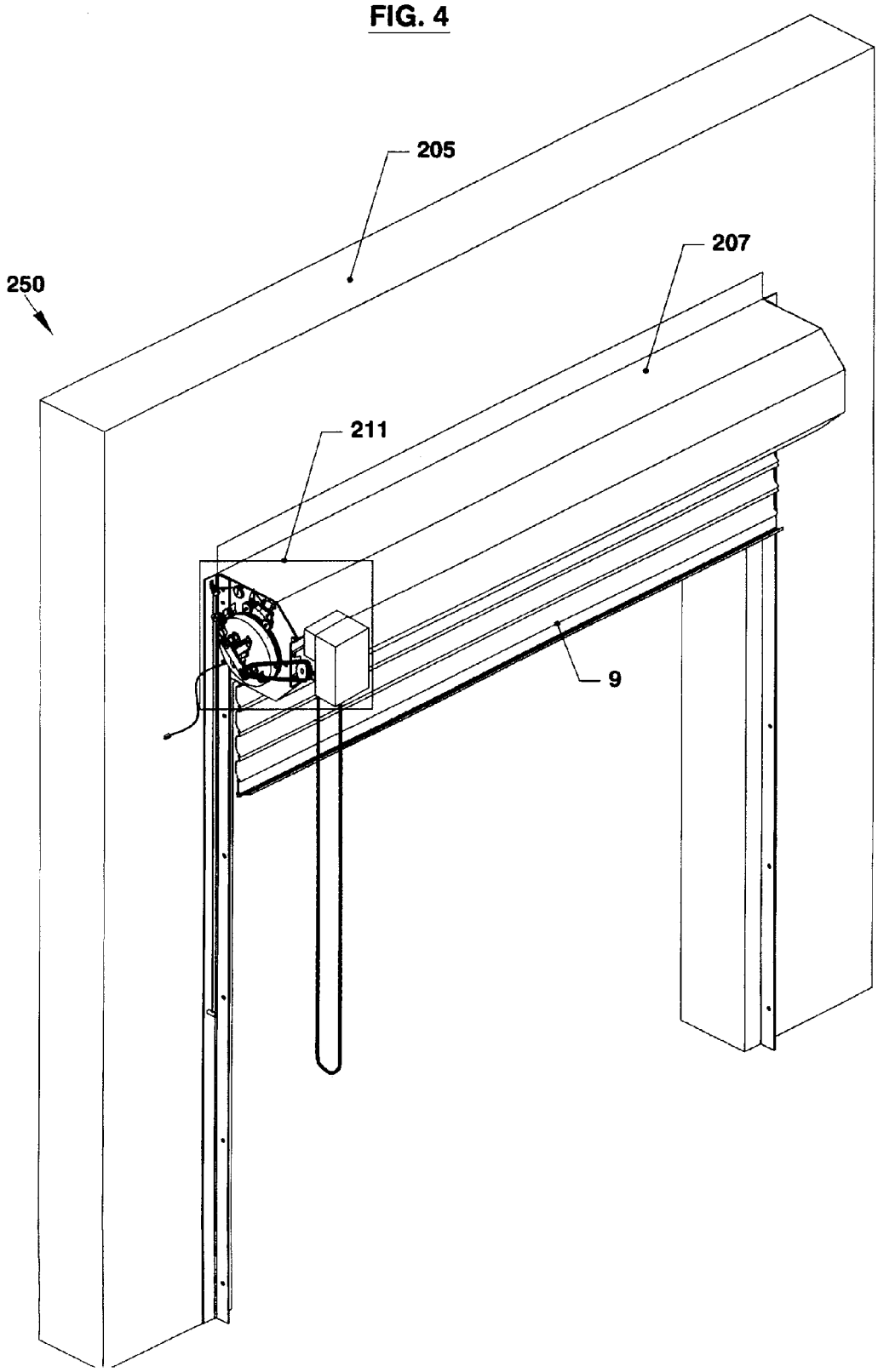
FIG. 4 is an isometric view of a curtain or roller door having a motorized chain drive, shown when the door is in the open position.

FIG. 4 is an isometric view of a curtain or rolling door 9 having a chain drive wherein the door is in the open position.

Turning to FIG. 4, there is shown an isometric view of the system 250 of the claimed invention having a curtain or rolling door 9 and having a motorized chain drive 211 wherein the door 9 is in the open position relative to the doorway of wall section 205. When rolled up under the control of the chain drive of the mechanism 211, the rolling door 9 is wrapped around a drum (not shown) that runs the length of housing 207.

The rolling door 9 is lowered or raised, as the case may be, by the electrical activation of a motor which drives the chain. The movement of the various components is described in more detail with respect to FIG. 6. The advantage of the current design is the ability to retrofit any of the primary embodiments to existing door drive systems or to upgrade from one embodiment to another.

Figure 5:
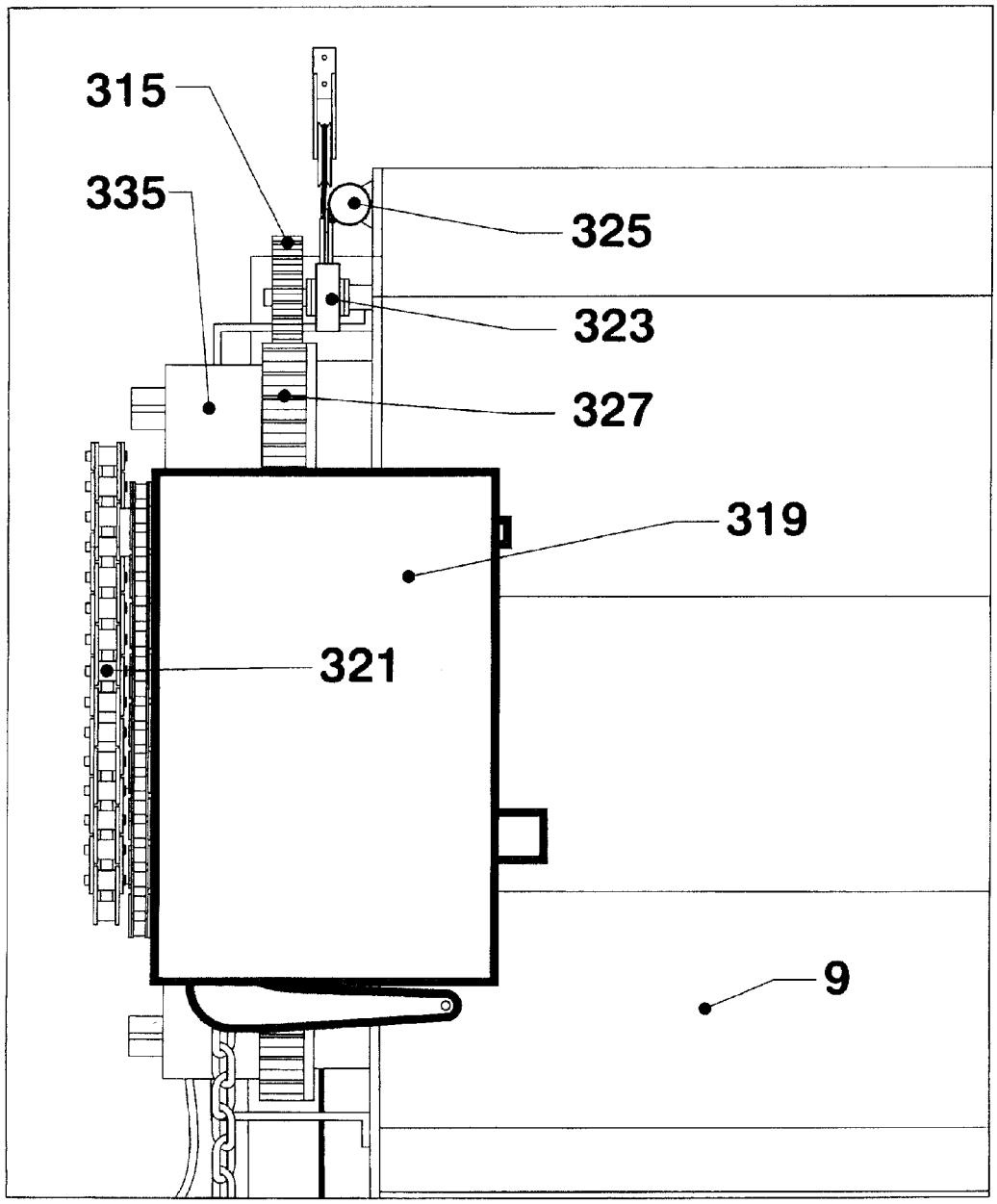
FIG. 5 is an elevation view of the chain drive embodiment of the present invention showing the top of the motor mount housing.

FIG. 5 is an elevation view of the chain drive embodiment of the present invention showing the top of the motor mount housing.

Chain drive 319 is shown where the chain drive 319 under control of a motor, contained within the chain drive housing 319, rotates a shaft which in turn rotates a gear (not shown in this perspective). The gear moves chain 321 which is connected to the main gear shafts which are connected with a chain therebetween (not shown). The main gear shafts, in turn, drive the interior mechanism of the gearbox 335 (described in more detail with respect to FIGS. 11 and 12), rotating drive gear 327, that causes the door 9 to be rolled up or down. The speed of the roll up is governed by the governor not shown, and measured by the rocker arm 323 through the rotation of rocker arm gear 315. Actuation of the rocker arm 323 for upward or downward movement of the rolling door 9 comes from the in or out action of solenoid 325 under control of the timing switch (not shown).

Figure 6:
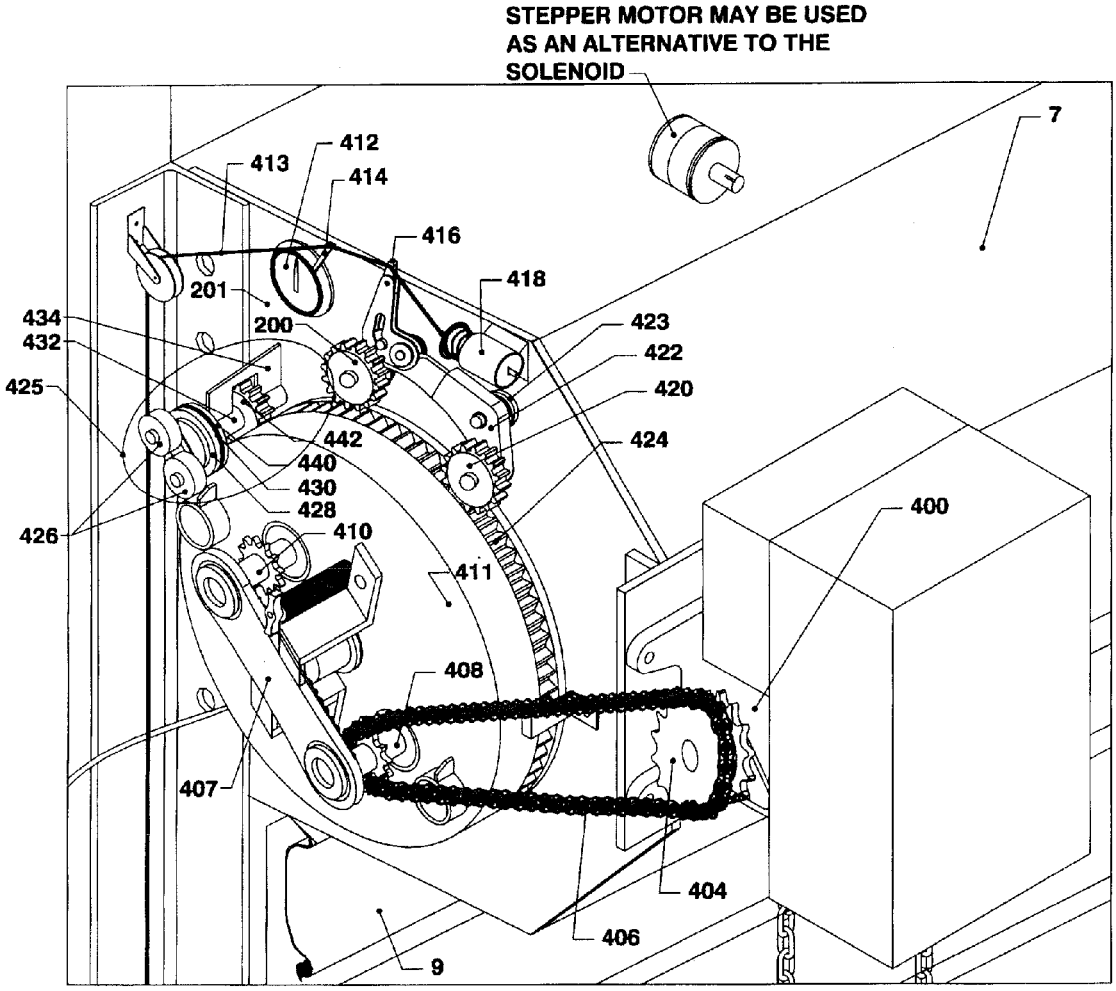
FIG. 6 is an isometric view of a motorized chain drive embodiment of the present invention showing the timer, solenoid, rocker arm assembly, and governor.

FIG. 6 is an isometric view of the chain drive embodiment of the present invention showing the timer 412, solenoid 418, rocker arm assembly 422, and the centrifugal speed governor 425.

The chain drive embodiment receives its drive power from the motor driven chain 401 being driven by motor 400 which is preferably a 24 volt DC motor which can be battery backed if necessary or desired. The mechanism and operator drive can be separated, where the mechanism will work in conjunction with external operators for larger size doors that require higher voltage units, where the operator needs a minimum of 110 volt, thru 575 volts. The motor turns gear 404 which moves chain 406. In turn, gear 404 causes chain 406 to move which drives main gear shaft 408. Main gear shaft 408 supports one end of a chain (not shown) which is covered and protected by plate 407. The other end of the protected chain drives main gear shaft 410. The movement of the main gear shafts 408, 410 causes the inner workings (as shown and described in FIGS. 11 and 12) of the gearbox 411 to rotate drive gear 424. Drive gear 424 rotates an inner shaft which causes the shaft to take up or release door 9 which is wound or unwound from a drum in housing 7. The directionality of the rotation up or down is controlled by the pivoting of the one-way bearing of the rocker arm assembly.

There is shown the rocker arm components of the rocker arm 422 as secured just past the 12:00 o'clock position relative to the top of the drive gear 424. Gear 420 is secured to rocker arm body 422 with a one-way bearing (not shown) disposed therebetween. Bracket attachment assembly 423 is used to secure the lower portion of rocker arm body 422 while allowing it to pivot between one way bearing gear 200 when activated so as to engage the gear 420 with the drive gear 424 to control speed under the directional control of the one-way bearings 200, 420. Cable holder 416 is secured between the upper portions of the swing bodies 417 so as to hold the cable 413 which links the solenoid 418 and timer switch 414. The cable is under direction of an emergency back up which causes the timer switch 412 to be set so as to position timer switch 414 in such a way as to elevate the cable 413 causing the solenoid 418 to be activated which pivots the one-way bearing 420 of the rocker arm to the other one way bearing 200. As the timer reaches its "timed out" position, the rocker arm 422 is dropped, causing the solenoid 418 to open which in turn pivots to the other one-way bearing so that the door 9 will close.

Alternatively, a stepper motor is used in place of the solenoid 418. When using the stepper motor, the motor is activated which pivots the rocker arm 422 to engage opposite directional, one-way bearing 200. As the timer reaches its "timed out" position, the timer switch 414 is dropped, causing the stepper motor to turn "a step", which in turn pivots rocker arm 422 to engage the one-way bearing 200 so that the rolling door 9 will close. To reverse the door, the timer arm is dropped after the lapse of the pre-set period of time. The stepper motor is re-activated and completes a turn of the shaft to reverse the one-way bearing.

Alternatively, the doors are driven horizontally (relative to the door's threshold) from opposing directions so that they meet in the middle of the threshold. The drive mechanism is the same as that provided for the vertical (up or down) movement of the door, except that the drive is biased horizontally instead of laterally.

The speed of the door's descent is extremely important in that too great a speed will cause the door to hit the full down position and bounce and be in the wrong position, or cause strain on the mechanism. To avoid these problems, the mechanism utilizes a centrifugal speed governor.

A view of the centrifugal speed governor 425, and its components, is shown wherein the governor 425 is shown as secured between the 10:00 and 11:00 o'clock positions relative to the top of the drive gear 424 (its position will be opposite if the mechanism becomes "right-handed"). Clutch weights 426, 426 are slot mounted on the upper portion of the rotor body assembly cap 428. Clutch pad 430 for braking is secured between the rotor body assembly cap 428 and the fixed rotor 440. Cap 428, clutch pad 430, and fixed rotor 440 are combined to form the rotor body assembly.

The rotor body assembly is transected in the center by shaft 432 which supports the rotor body assembly on one end and the governor gear 442 on the opposite end. The gear 442 is in mated contact with the system's main drive gear 424 so as to control the speed of the door 9. The gear 442 bisects the supports 434 which are perpendicular to each other and welded to the bracket 201.

When activated, the governor 425 rotates to a certain speed, when that speed is increased beyond the threshold speed, slot mounted weights 426 are pulled apart by centrifugal force which causes pressure on the clutch pad 430, causing the governor 425 to brake the speed of the door's descent.

Figure 7:
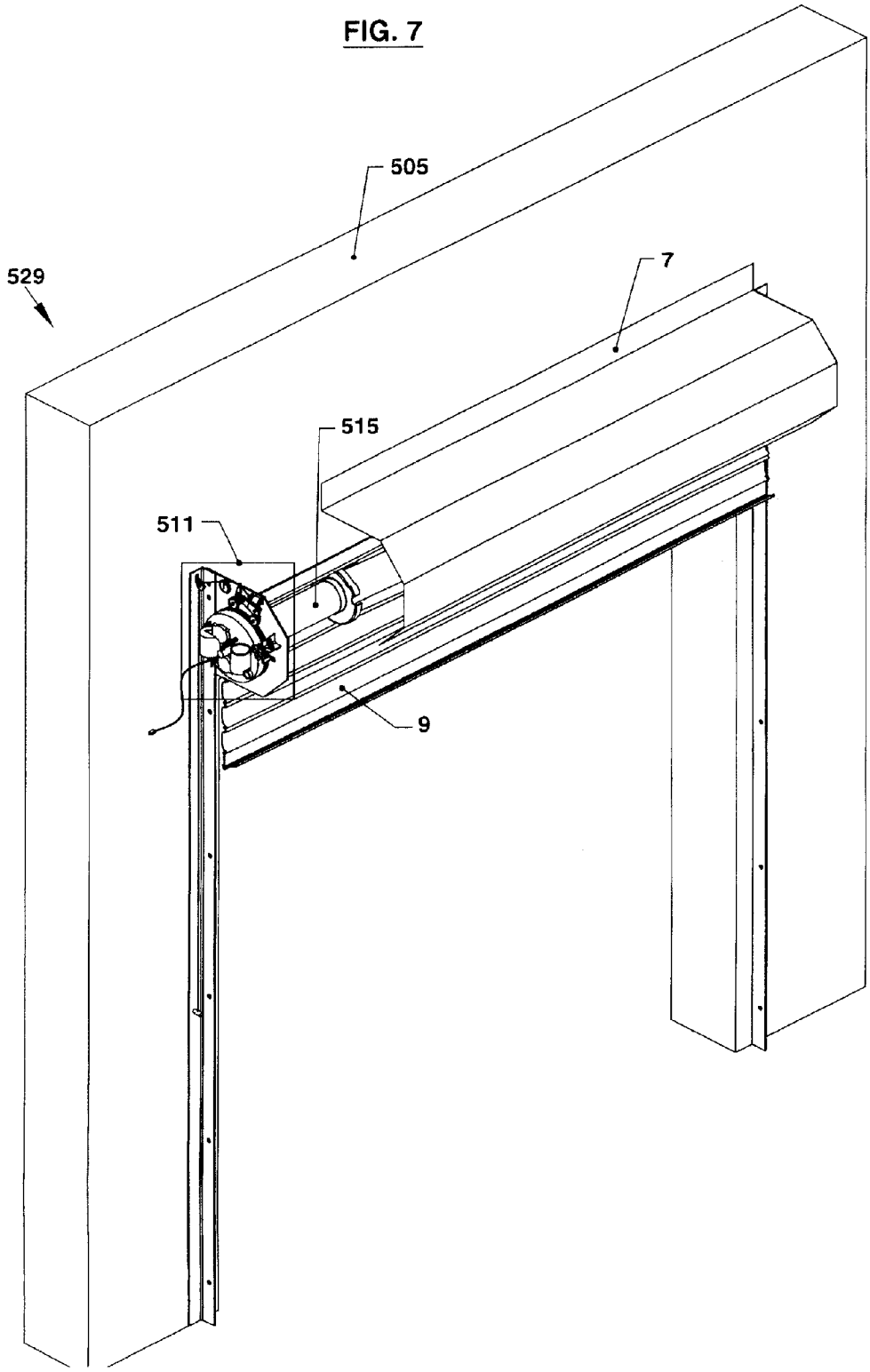
FIG. 7 is an isometric view of a curtain or roller door having a 24 v motor drive wherein the door is in the open position.

FIG. 7 is an isometric view of a curtain or rolling door having a 24 v motor drive wherein the door is in the open position.

Turning to FIG. 7, there is shown an isometric view of the system 550 of the claimed invention having a curtain or roller door 9 and having a motor drive wherein the door 9 is in the open position relative to the doorway of wall section 505. When rolled up under the control of the motor drive of the mechanism 511, the door 9 is wrapped around a drum 515 that runs the length of the interior of housing 207.

The door 9 is lowered or raised, as the case may be, by the electrical activation of a motor which directly drives the inner workings of the gear box to drive the drive gear. The movement of the various components is described in more detail with respect to FIG. 9. The advantage of the current design is the ability to retrofit any of the primary embodiments to existing door drive systems or to upgrade from one embodiment to another.

Figure 8:
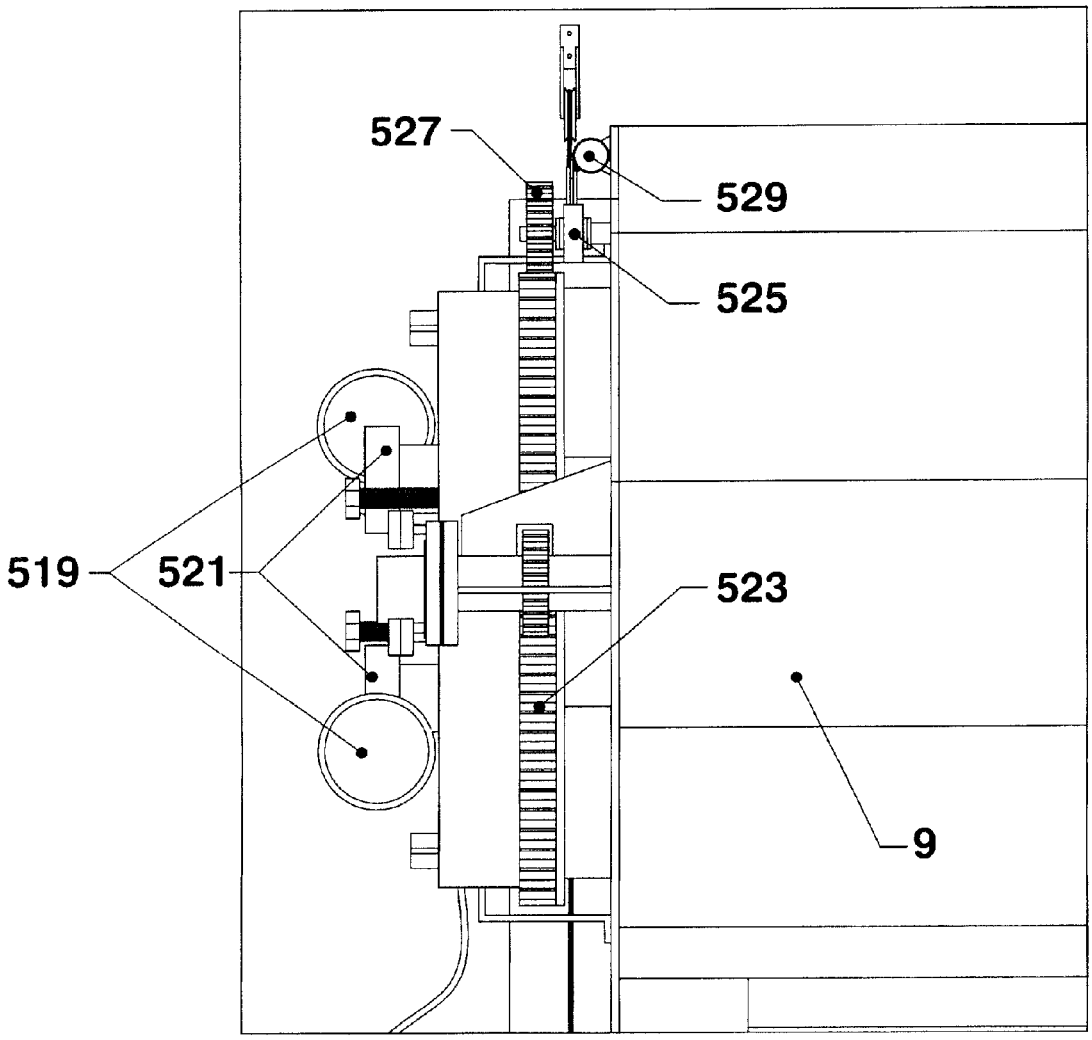
FIG. 8 an elevation view of the 24 volt motor drive embodiment of the present invention showing the side of the motor mount housing.

FIG. 8 an elevation view of the 24 volt motor drive embodiment of the present invention showing the side of the motor mount housing.

Motor drive 519 is shown to drive a gear and worm gear assembly 521, contained within the motor drive housing 519, rotates a shaft which in turn rotates a gear (not shown in this perspective). The gear moves drives the drive gear 523 in accordance with the description of FIGS. 11 and 12 herein. The rotating drive gear 523 causes the door 9 to be rolled up or down. The speed of the roll up is governed by the governor not shown, and measured by the rocker arm 525 through the rotation of rocker arm gear 527. Actuation of the rocker arm 525 for upward or downward movement of the door 9 comes from the in or out action of solenoid 529 under control of the timing switch (not shown).

Figure 9:
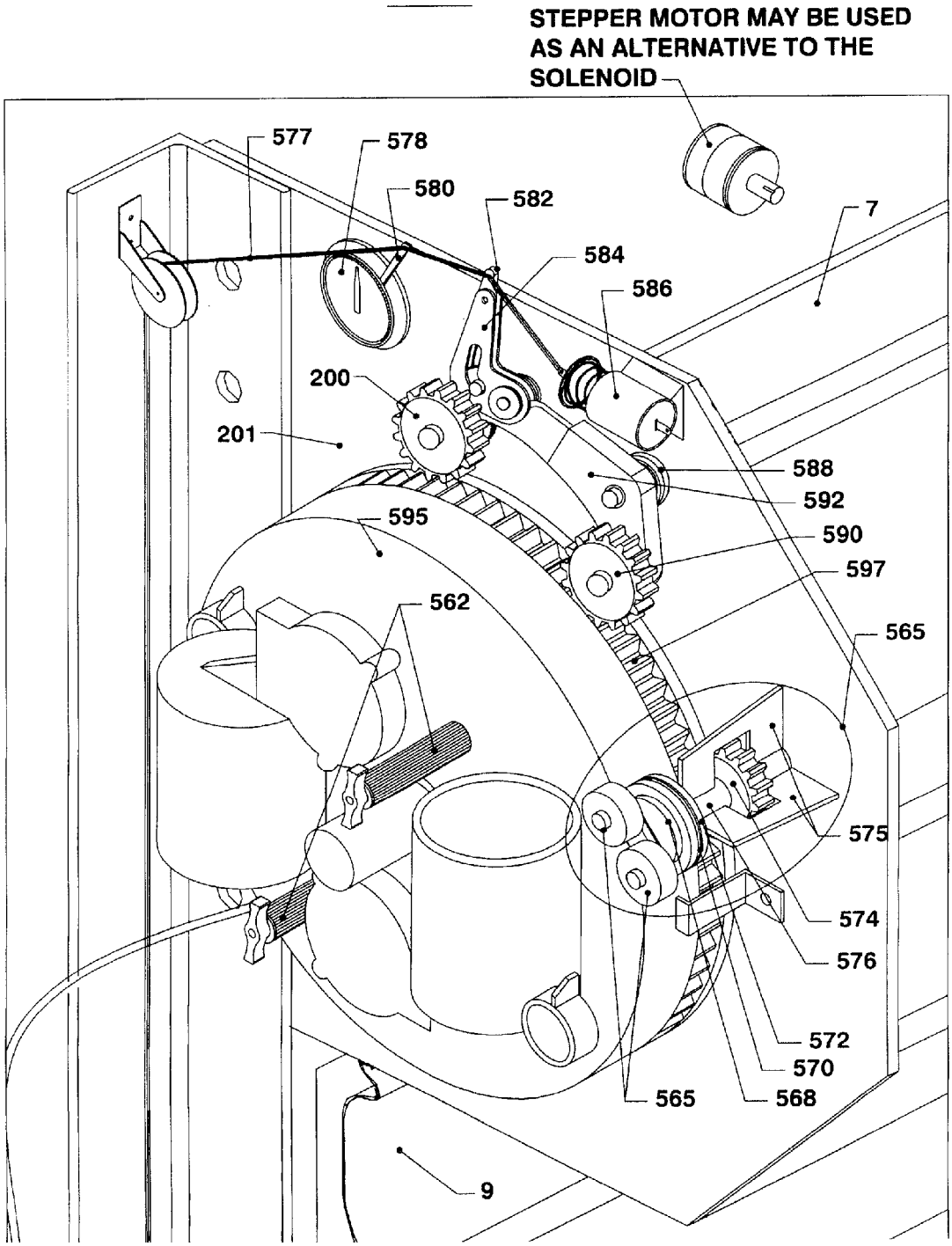
FIG. 9 is an isometric view of the 24 volt motor embodiment of the present invention showing the timer, solenoid, rocker arm assembly, and governor.

FIG. 9 is an isometric view of the 24 volt motor embodiment of the present invention showing the timer 578, solenoid 586, rocker arm assembly 592, and the centrifugal speed governor 565.

The motor embodiment receives its drive power from the motor 560 mounted directly until the gearbox 595. The motor 560 is preferably a 24 volt DC motor which can be battery backed if necessary, or desired; however, for driving heavier loads or peripheral features, a 100 volt motor may be advantageous. Its only drawbacks will be weight and the ineffectiveness of using battery back-up for the high power draw device.

The motor 560 turns the inner workings (as shown and described in FIGS. 11 and 12) of the gearbox 595 to rotate drive gear 597. Drive gear 597 rotates an inner shaft which causes the shaft to take up or release door 9 which is wound or unwound from a drum in housing 7. The directionality of the rotation up or down is controlled by the pivoting of the one way bearings of the rocker arm assembly. Adjusting posts 562 allow for system adjustment of the timing of the internal gears of the gearbox without having to remove the mechanism from the doorway, or to open up the gearbox for simple adjustments.

There is shown the rocker arm components of the rocker arm 592 as secured just past the 12:00 o'clock position relative to the top of the drive gear 597. Gears 590, 200 are secured to rocker arm body 592 with a one-way bearing (not shown) disposed therebetween. Bracket attachment assembly 588 is used to secure the lower portion of rocker arm body 592 while allowing it to pivot when activated so as to engage the gear 590, or the gear 200, with the drive gear 597 to control speed under the directional control of the one-way bearings. Cable holder 582 is secured between the upper portions of the swing bodies 584 so as to hold the cable 577 which links the solenoid 586 and timer switch 578. The cable 577 is under direction of an emergency back up which causes the timer switch 578 to be set so as to position timer switch 580 in such a way as to elevate the cable 577 causing the solenoid 586 to be activated which pivots the rocker arm from one one-way bearing to the other one-way bearing. As the timer reaches its "timed out" position, the timer switch 580 is dropped, causing the solenoid 586 to open which in turn pivots the rocker arm 592 from one one-way bearing to the other one-way bearing so that the door 9 will close.

Alternatively, a stepper motor is used in place of the solenoid 586. When using the stepper motor, the motor is activated which pivots the rocker arm 422 to engage opposite directional, one-way bearing 200. As the timer reaches its "timed out" position, the timer switch 580 is dropped, causing the stepper motor to turn "a step", which in turn pivots rocker arm 592 to engage the one-way bearing 200 so that the rolling door 9 will close. To reverse the door, the timer switch 580 is dropped after the lapse of the pre-set period of time. The stepper motor is re-activated and completes a turn of the shaft to reverse the one-way bearing.

Alternatively, the doors are driven horizontally (relative to the door's threshold) from opposing directions so that they meet in the middle of the threshold. The drive mechanism is the same as that provided for the vertical (up or down) movement of the door, except that the drive is biased horizontally instead of laterally.

The speed of the door's descent is extremely important in that too great a speed will cause the door to hit the full down position and bounce and be in the wrong position, or cause strain on the mechanism. To avoid these problems, the mechanism utilizes a centrifugal speed governor.

A view of the centrifugal speed governor 565, and its components, is shown wherein the governor 565 is shown as secured between the 2:00 and 3:00 o'clock position relative to the top of the drive gear 597 (its position could change if the mechanism becomes "right-handed"). Clutch weights 566, 566 are slot mounted on the upper portion of the rotor body assembly cap 568. Clutch pad 570 for braking is secured between the rotor body assembly cap 568 and the fixed rotor 572. Cap 568, clutch pad 570, and fixed rotor 572 are combined to form the rotor body assembly.

The rotor body assembly is transected in the center by shaft 576 which supports the rotor body assembly on one end and the governor gear 574 on the opposite end. The gear 574 is in mated contact with the system's main drive gear 597 so as to control the speed of the door 9. The gear 574 bisects the supports 575, 575 which are perpendicular (90 degrees) to each other and welded to the bracket 201.

When activated, the governor 565 rotates to a certain speed, when that speed is increased beyond the threshold speed, slot mounted weights 566 are pulled apart by centrifugal force which causes pressure on the clutch pad 570, causing the governor 565 to brake the speed of the door's descent.

Figure 10A:
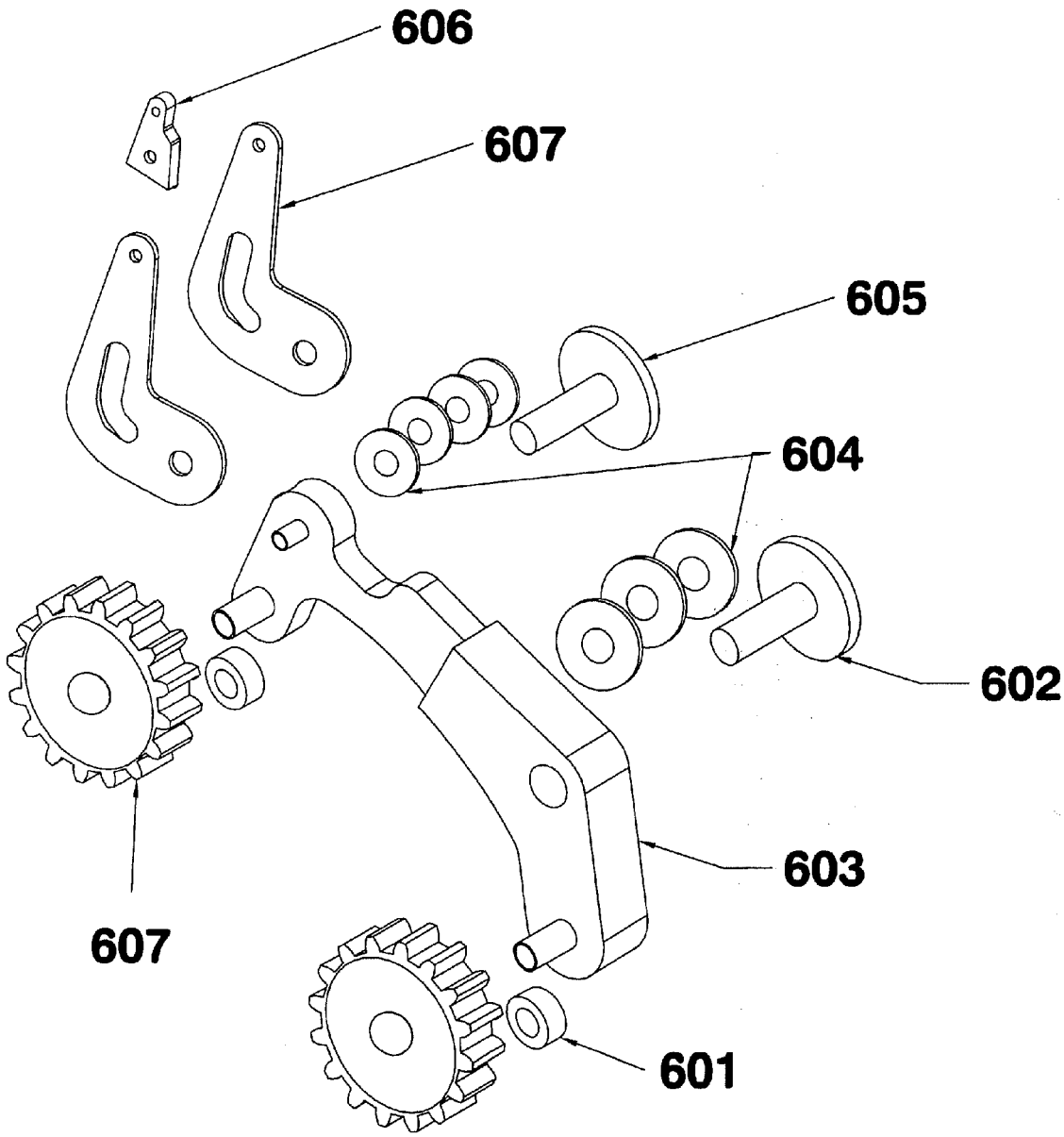
FIG. 10A is an exploded view of the rocker arm components of the rocker arm.

FIG. 10A is an exploded view of the rocker arm components of the rocker arm 620 as secured just past the 12:00 o'clock position relative to the top of the drive gear as is shown in FIG. 9. Gear 600, 600 is secured to rocker arm body 603 with one-way bearings 601, 601 disposed therebetween. Bracket attachment assembly 602 is used to secure the lower portion of rocker arm body 603 while allowing it to pivot when activated so as to pivot between directional bearings gears and the drive gear to control speed under the directional control of the one-way bearings 601, 601. Brass washers 604 provide spacing for the fixed shaft 605 which joins brass swing bodies 607 to the rocker arm body 602 on opposite sides of the upper portion of the rocker arm body 608, which allows the upper portion of the rocker arm body 608 to pivot so as to engage either one of the directional bearing gears. Cable holder 606 is secured between the upper portions of the brass swing bodies 607 so as to hold the cable which links the solenoid and timer switch (see FIG. 3).

Figure 10B:
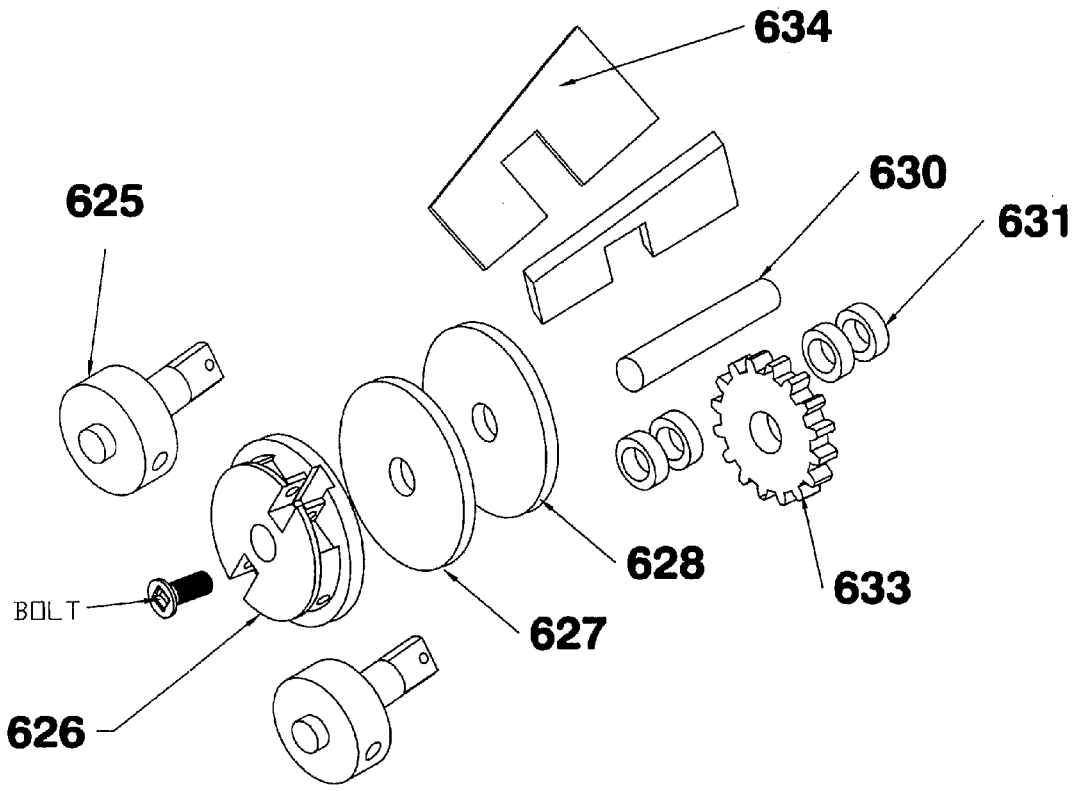
FIG. 10B is an exploded view of the centrifugal governor components of the governor.

Turning next to FIG. 10B, there is shown an exploded view of the centrifugal governor components of the governor 650 as secured between the 2:00 and 3:00 o'clock positions relative to the top of the drive gear as is shown in FIG. 9. Clutch weights 625 are slot mounted on the upper portion of the rotor body assembly cap 626. Clutch pad 627 for braking is secured between the rotor body assembly cap 626 and the fixed rotor 628. Cap 626, clutch pad 627, and fixed rotor 628 are combined to form the rotor body assembly.

The rotor body assembly is transected in the center by shaft 630 which supports the rotor body assembly on one end and the governor gear 633 on the opposite end. The gear 633 is in mated contact with the system's main drive gear so as to control the speed of the door. The gear bisects the supports 634 which are perpendicular (90 degrees) to each other and welded to the bracket of the surface mount. A set of top bearings 631 and bottom bearings 632 are supported by the bearing cover sleeves 629, 629 respectively which are in turn supported by the shaft and located on opposite sides of the gear 633.

When activated, the governor 650 rotates to a certain speed, when that speed is increased beyond the threshold speed, slot mounted weights 625 are pulled apart by centrifugal force which causes pressure on the clutch pad 627, causing the governor 650 to brake the speed of the door's descent.

Figure 11:
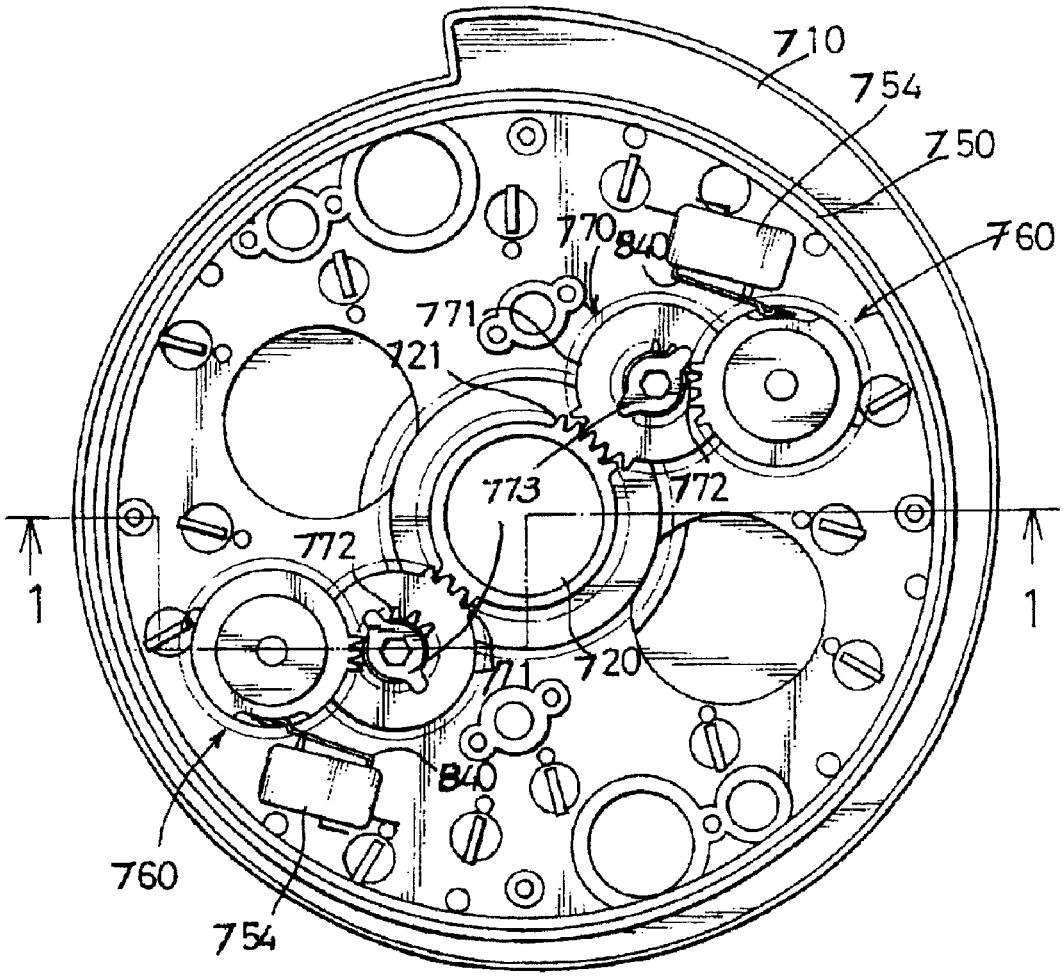
FIG. 11 is an elevation view of the embodiment of the interior of the gear box of the present invention.
Figure 12:
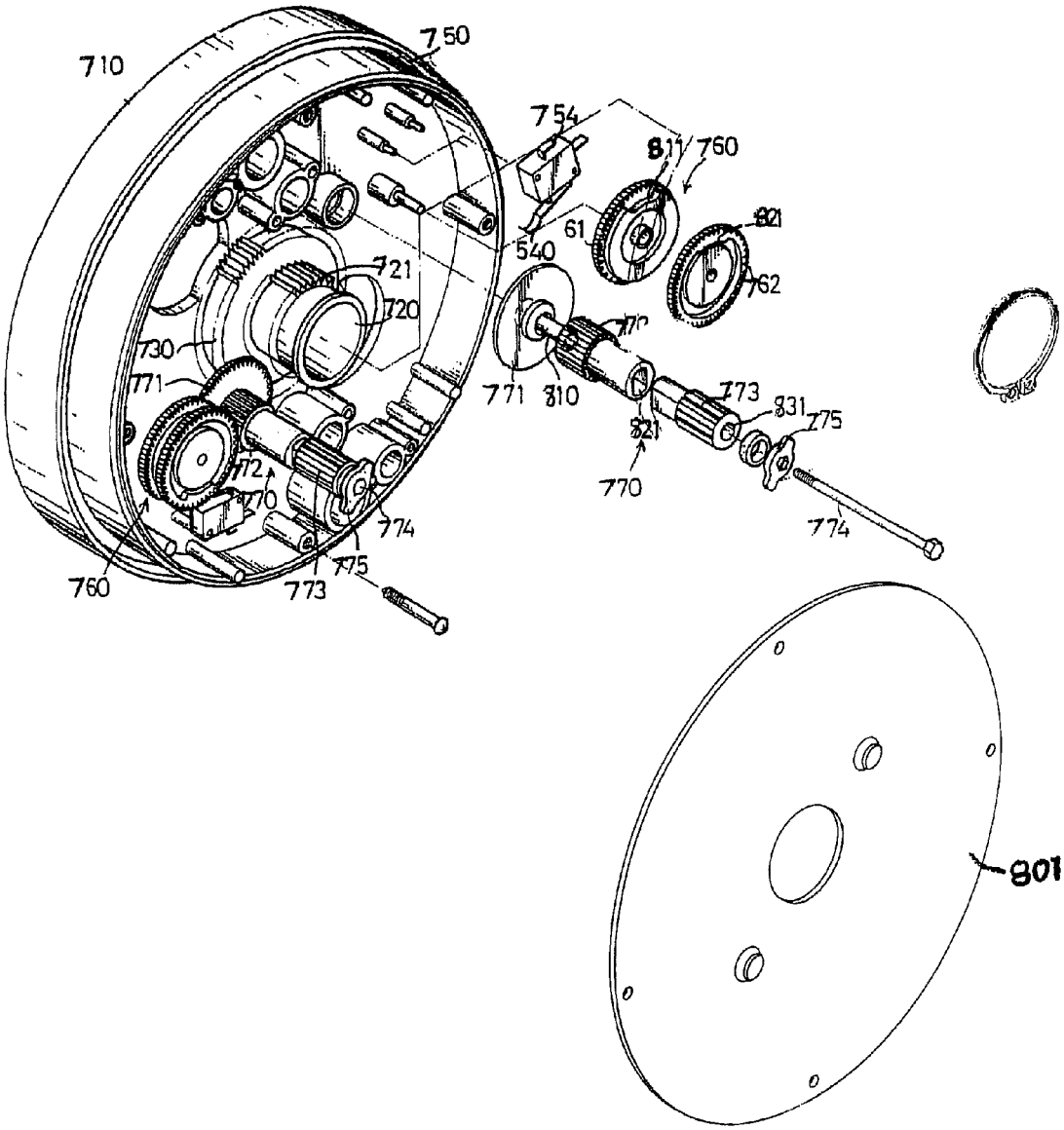
FIG. 12 is an exploded view of the embodiment of the interior of the gear box of the present invention.

The internal workings of the system are best understood by reference to FIG. 11 and FIG. 12.

FIG. 11 is a plan view of the embodiment of the interior of the present invention; and, FIG. 12 is an exploded view of the embodiment of the interior of the gear box of the present invention. Together, the two FIGs. describe the gearbox for the present invention.

As is shown in FIG. 11, two adjustable control means, each of which includes a timing gearset 760, an adjusting gearset 770 and a micro-switch 754, are mounted in the stationary housing 750. The timing gearset 760 includes a first timing gear 761 and a second timing gear 762 as are shown in FIG. 12. The first timing gear 761 has a first recessed surface 811 defined thereon. The second timing gear 762 has a second recessed surface 821 defined thereon. The first timing gear 761 and the second timing gear 762 have a same pitch number (diametral pitch) and a same pitch diameter, but have different tooth numbers.

The first timing gear 761 and the second timing gear 762 are coaxially mounted in the stationary housing 750. The first recessed surface 811 of the first timing gear 761 is arranged to face the second recessed surface 821 of the second timing gear 762 and the two recessed surfaces 811 and 821 are offset by a predetermined angle in the beginning. Since the tooth number of the first timing gear 761 is different from the tooth number of the second timing gear 762, the first recessed surface 811 of the first timing gear 761 and the second recessed surface 821 of the second timing gear 762 can coincide with each other when the first timing gear 761 and the second timing gear 762 are rotated, which depends on the difference of the tooth number between the two timing gears.

The adjusting gearset 770 (as shown in FIG. 11) includes a first adjusting gear 771, a second adjusting gear 772, an adjusting knob 773, and a connecting rod 774. The first adjusting gear 771 is mounted in the stationary housing 750 to mesh with the geared portion 721 of the central hub 720 of the driving plate 710. The second adjusting gear 772 is coaxially mounted with the first adjusting gear 771. The second adjusting gear 772 is disposed to mesh with the first timing gear 761 and the second timing gear 762.

As is shown in FIG. 12, the first adjusting gear 771 has a hub 810 formed at the center thereof. The second adjusting gear 772 is formed as a geared axle in which a circular cross-sectional recess (not shown) and a non-circular cross-sectional recess (not shown) are defined. The circular cross-sectional recess is matched with the non-circular cross-sectional recess. The circular cross-sectional recess is capable of receiving the hub 810 (FIG. 12) of the first adjusting gear 71. The non-circular cross-sectional recess is capable of receiving the adjusting knob 773 which has a through hole 831 defined therein. It is to be noted that the adjusting knob 773 and part of the second adjusting gear 772 are disposed outside of the stationary housing 750 to conduct an adjustment without dis-assembling the stationary housing 750. The connecting rod 774 can be inserted in the through hole 831 of the adjusting knob 773 and the central hub 810 of the first adjusting gear 771 to be threadedly engaged with the nut (not shown) provided in the hub 810 to have the second adjusting gear 772 frictionally engaged with the first adjusting gear 771, so that the second adjusting gear 772 can be integrally rotated with the first adjusting gear 771. In such an arrangement, when the sun gear 730 is driven to rotate by a motor, the first timing gear 761 and the second timing gear 762 can be rotated via the adjusting gearset 770.

As can be seen in FIG. 12, the connecting rod 774 is preferably provided with a wing-like head 775 for facilitating manual adjustment. By means of the wing-like head 775, the engagement or disengagement between the first adjusting gear 771 and the second adjusting gear 772 can be easily rendered.

As is shown in FIG. 11, each micro-switch 754 has an actuating lever 840 which is placed in contact with a corresponding timing gearset 760, which includes the first timing gear 761 and the second timing gear 762. In such an arrangement, when the motor drives the sun gear 730 in one direction to rotate the driving plate 710 to raise the roller-shutter door, the actuating lever 840 of one micro-switch 754 (first) can extend into the recess which is formed by the coincidence of the first recessed surface 811 (FIG. 12) and the second recessed surface 821, so that the first micro-switch 754 can be de-actuated to stop the motor. At this time, the roller-shutter door is moved to an upper predetermined limit position.

When the motor drives the sun gear 730 in an opposite direction to rotate the driving plate 710 to lower the roller-shutter door, the actuating lever 840 of the other micro-switch 754 (second) can extend into the recess which is formed by the coincidence of the first recessed surface 811 and the second recessed surface 821, so that the second micro-switch 754 can be de-actuated to stop the motor. At this time, the roller-shutter door is moved to a lower predetermined limit position. When the aforementioned "upper predetermined limit position" or the aforementioned "lower predetermined limit position" need to be changed to be adaptable for a roller-shutter door of a different height, a corresponding connecting rod 774 can be threadedly unfastened from a corresponding nut (not shown) to allow a corresponding second adjusting gear 772 to disengage from a corresponding first adjusting gear 771. Therefore, the corresponding second adjusting gear 772 can be turned relative to the corresponding first adjusting gear 771 to change the position of the recessed surface 811 of the first timing gear 761 relative to the recessed surface 821 of the second timing gear 762, thereby controlling the time at which the motor can be stopped to allow a roller-shutter door to be moved to another limit position.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A method for driving a roller-shutter door having a drive mechanism, said method comprising the steps of:

(a) activating a switch in response to an external stimulus, said activation actuating a timer wherein said actuation raises a timing arm;

(b) raising said timing arm;

(c) raising a cable passing across a top portion of said timing bar and wherein said cable passes connected to said switch on one end and to a solenoid on a second end and wherein said cable passes through a top portion of a rocker arm assembly disposed between said timer and said solenoid; and, wherein said rocker arm assembly comprises a one-way bearing;

(d) actuating said solenoid as a result of said raising of Said timing bar; and (e) activating said one-way bearing to cause said door to be raised to a pre-set position for a pre-set period of time under control of said timer and as driven by said drive mechanism.

2. The method of claim 1, wherein said external stimulus is a closing of a circuit linked to a sensor for measuring an anomaly.

3. The method of claim 2, wherein said anomaly is an elevated smoke level within a contained area comprising said roller shutter door.

4. The method of claim 2, wherein said anomaly is an elevated wind level within a contained area comprising said roller shutter door.

5. The method of claim 2, wherein said anomaly is an elevated heat level within a contained area comprising said roller shutter door.

6. The method of claim 2, wherein said anomaly is a time limit imposed by a real time clock.

7. The method of claim 2, wherein said switch is located on an outer wall of a building supporting said roller shutter door; and wherein said switch is within a break-glass station.

8. The method of claim 1, comprising the steps of:

(a) utilizing said timer for a pre-set period of time;

(b) dropping said timer bar after a lapse of said pre-set period of time;

(c) re-activating said solenoid in response to said dropping of said timer bar;

(d) reversing said one-way bearing in response to said actuation of said solenoid; and (e) dropping said door to a closed position in response to said reversing of said one-way bearing.

9. The method of claim 8, wherein a speed of said dropping of said door is under control of a centrifugal speed governor.

10. The method of claim 1, wherein said drive mechanism further comprises a 24 volt operator mechanism and wherein said 24 volt operator mechanism further comprises a battery back-up.

11. A method for driving a roller-shutter door comprising the steps of:

(a) activating a switch in response to an external stimulus, said activation actuating a drive mechanism;

(b) activating a solenoid in response to said actuation of said drive mechanism;

(c) raising a cable in response to said activation of said solenoid, said cable passing across through a top portion of a rocker arm assembly disposed between a timer and said solenoid; and, wherein said rocker arm assembly comprises a one-way bearing;

(d) reversing said one-way bearing as a result of said activation of said solenoid; and (e) lowering said door to a closed position.

12. The method of claim 11, wherein said lowering of said door is effected by gravity acting upon said door and wherein speed of descent is under control of a centrifugal speed governor.

13. The method of claim 11, wherein said switch is located on an outer wall of a building supporting said roller shutter door; and wherein said switch is within a break-glass station.

14. A drive mechanism for opening or closing a roller-shutter door, said drive mechanism comprising:

(a) a drive plate having a centrally located hub, said hub having a geared portion located on an outside surface thereof;

(b) a drive gearset having a geared hub mounted coaxially about said central hub of said drive plate;

(c) a second gear having a geared hub and mounted coaxially about said geared hub;

(d) a stationary housing adapted to accommodate said drive gearset and said drive plate;

(e) a motor located externally to said stationary housing for driving said second gear;

(f) control means disposed within said stationary housing and in meshed contact with said central hub for controlling actuation of said motor in response to an external stimulus to a switch and whereby said roller-shutter door can be moved to a predetermined limit position; and (g) a centrifugal speed governor for controlling a speed of movement of said roller shutter door relative to said predetermined limit position.

15. The drive mechanism of claim 14, wherein said control means comprises an adjustable gearset, said gearset being accessible from outside said stationary housing.

16. The drive mechanism of claim 14, wherein said mechanism further comprises a rocker arm assembly having a one-way bearing, said rocker arm assembly responsive to signals from a solenoid for determining a direction to be controlled by said one-way bearing.

17. The drive mechanism of claim 14, wherein said mechanism further comprises a rocker arm assembly having a one-way bearing, said rocker arm assembly responsive to signals from a stepper motor for determining a direction to be controlled by said one-way bearing.

18. The drive mechanism of claim 14, wherein said external stimulus is a closing of a circuit linked to a sensor for measuring an anomaly.

19. The drive mechanism of claim 18, wherein said anomaly is an elevated smoke level within a contained area comprising said roller shutter door.

20. The drive mechanism of claim 18, wherein said anomaly is an elevated wind level within a contained area comprising said roller shutter door.

21. The drive mechanism of claim 18, wherein said anomaly is an elevated heat level within a contained area comprising said roller shutter door.

22. The drive mechanism of claim 18, wherein said anomaly is a time limit imposed by a real time clock.

23. The drive mechanism of claim 18, wherein said switch is located on an outer wall of a building supporting said roller shutter door; and, wherein said switch is within a break-glass station.

24. The drive mechanism of claim 14, wherein said drive mechanism further comprises a 24 volt operator mechanism and wherein said 24 volt operator mechanism further comprises a battery back-up.

25. A method for driving a roller-shutter door comprising the steps of:

(a) activating a switch in response to an external stimulus, said activation actuating a drive mechanism;

(b) activating a stepper motor in response to said actuation of said drive mechanism;

(c) raising a cable in response to said activation of said stepper motor, said cable passing across through a top portion of a rocker arm assembly disposed between a timer and said stepper motor; and, wherein said rocker arm assembly comprises a one-way bearing;

(d) reversing said one-way bearing as a result of said activation of said stepper motor; and (e) lowering said door to a closed position.

26. The method of claim 25, wherein said lowering of said door is effected by gravity acting upon said door and wherein speed of descent is under control of a centrifugal speed governor.

27. The method of claim 25, wherein said switch is located on an outer wall of a building supporting said roller shutter door; and wherein said switch is within a break-glass station.

* * * * *